US012325965B1

(12) United States Patent
Nerys

(10) Patent No.: US 12,325,965 B1
(45) Date of Patent: Jun. 10, 2025

(54) DEPLOYABLE SAFETY BARRIER FOR JOB SITES

(71) Applicant: Hector Nerys, Elmont, NY (US)

(72) Inventor: Hector Nerys, Elmont, NY (US)

( * ) Notice: Subject to any disclaimer, the term of this patent is extended or adjusted under 35 U.S.C. 154(b) by 238 days.

(21) Appl. No.: 18/209,940

(22) Filed: Jun. 14, 2023

(51) Int. Cl.
*E01F 13/02* (2006.01)

(52) U.S. Cl.
CPC ..... *E01F 13/028* (2013.01)

(58) Field of Classification Search
CPC . E01F 13/028; E01F 9/60; E01F 9/604; E01F 15/14; E06B 9/60; E06B 9/80; E06B 9/08; E06B 9/56; E06B 11/027
See application file for complete search history.

(56) References Cited

U.S. PATENT DOCUMENTS 3,220,464 A * 11/1965 Wise ..... G03B 21/58 160/281
5,636,679 A * 6/1997 Miller ..... E06B 9/08 160/231.1
6,142,701 A * 11/2000 Falcon ..... E01F 13/028 404/9
6,575,435 B1 * 6/2003 Kotzen ..... E06B 9/18 256/25
6,733,204 B1 * 5/2004 Paniccia ..... E01F 7/00 404/9
7,178,792 B2 * 2/2007 Monahan ..... E06B 9/08 256/73
7,207,370 B2 * 4/2007 Snyder ..... E01F 13/028 242/380
7,217,061 B2 * 5/2007 Stratton ..... E01F 13/028 160/250
7,219,709 B1 * 5/2007 Williams ..... E01F 13/028 160/24
7,438,112 B2 * 10/2008 Cheng ..... E01F 13/028 242/385.4
8,191,604 B2 * 6/2012 Wang ..... E06B 9/0692 160/293.1
8,887,441 B2 * 11/2014 Lundh ..... E06B 9/08 49/55
8,991,470 B1 * 3/2015 Pacheco ..... G08B 3/00 160/350
9,351,599 B2 * 5/2016 Roberts ..... E06B 9/54
9,482,052 B2 11/2016 Sousa et al.
9,598,896 B1 * 3/2017 Pichik ..... E06B 9/13
9,714,491 B2 * 7/2017 Wettern ..... E01F 13/022
(Continued)

*Primary Examiner* — Beth A Stephan
(74) *Attorney, Agent, or Firm* — Sanchelima & Associates, P.A.; Jesus Sanchelima; Christian Sanchelima

(57) ABSTRACT

A deployable safety barrier for job sites including a post assembly, a barrier assembly, and a netting assembly. Post assembly includes a tubular structure attached to a base, wherein the base is anchored to the ground to provide structural support to the post. A Toe kick is mounted on the base by means of toe kick securements to provide a protection against debris. Barrier assembly includes a fireproof netting rewound inside the post by means of a winder mechanism. The netting includes indicia to prevent unauthorized entry when deployed. Post further includes receiving members to secure a netting from another post, thus a barrier is formed. Warning assembly includes a strobe light to provide a visual alarm when the barrier is deployed, the strobe light is powered by means of a rechargeable battery electrically connected to a solar panel.

13 Claims, 4 Drawing Sheets

(56) References Cited

U.S. PATENT DOCUMENTS

| | | | | |
|---|---|---|---|---|
| 10,100,574 | B2 * | 10/2018 | Reiner | E06B 9/60 |
| 10,329,781 | B2 | 6/2019 | Blinn | |
| 10,422,091 | B1 * | 9/2019 | Moir | E04H 17/20 |
| 11,900,834 | B2 * | 2/2024 | Reiner | G09F 15/0062 |
| 2006/0131551 | A1 * | 6/2006 | Hopp | E01F 13/028 256/21 |
| 2006/0151123 | A1 * | 7/2006 | Chandler | E06B 9/08 160/24 |
| 2008/0121352 | A1 * | 5/2008 | Cheng | E06B 9/08 160/238 |
| 2010/0301296 | A1 * | 12/2010 | Ratzenberger | E01F 13/028 256/24 |
| 2015/0376942 | A1 * | 12/2015 | Henderson | E06B 9/08 160/192 |
| 2017/0032720 | A1 * | 2/2017 | Yang | G09F 27/005 |
| 2017/0038004 | A1 * | 2/2017 | Kalinski | E01F 13/028 |
| 2018/0044868 | A1 * | 2/2018 | Miller | E01F 13/028 |
| 2019/0063018 | A1 * | 2/2019 | Reiner | B65H 75/4471 |
| 2021/0054586 | A1 * | 2/2021 | Wiegel | E01F 13/048 |
| 2022/0157206 | A1 * | 5/2022 | Kay | E01F 13/028 |
| 2023/0417000 | A1 * | 12/2023 | Weiner | E01F 9/617 |

* cited by examiner

DEPLOYABLE SAFETY BARRIER FOR JOB SITES

BACKGROUND OF THE INVENTION

1. Field of the Invention

The present invention relates to safety barriers and, more particularly, to a deployable safety barrier for job sites that includes a flexible netting rolled inside a post which is capable of being unwound from the post to form a safety barrier.

2. Description of the Related Art

Several designs for deployable safety barriers for job sites have been designed in the past. None of them, however, include a post with a winder mechanism therein, where a cartridge with a flexible netting is mounted on the winder mechanism, allowing the netting to be deployed from the post to form a barrier, wherein the post includes eye hooks to receive the netting from another post, and the post further includes a strobe on top thereof to provide a visual alarm.

Applicant believes that a related reference corresponds to U.S. Pat. No. 10,329,781 issued for safety barrier netting system. Applicant believes that another related reference corresponds to U.S. Pat. No. 9,482,052 issued for a safety gate with a rewindable, flexible barrier. None of these references, however, teach a flexible barrier that is formed from a fireproof material that contains reflective strips and Led lighting devices where the barrier can be deployed from freestanding; and spring biased preventing unauthorized access to the site.

Other documents describing the closest subject matter provide for a number of more or less complicated features that fail to solve the problem in an efficient and economical way. None of these patents suggest the novel features of the present invention.

SUMMARY OF THE INVENTION

It is one of the objects of the present invention to provide a safety barrier to prevent unauthorized entry at job sites or the like.

It is another object of this invention to provide a device that can be used either freestanding or anchored onto the ground.

It is still another object of the present invention to provide a retractable netting inside a post to provide a portable device that is transported when required.

It is yet another object of this invention to provide such a device that is inexpensive to implement and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
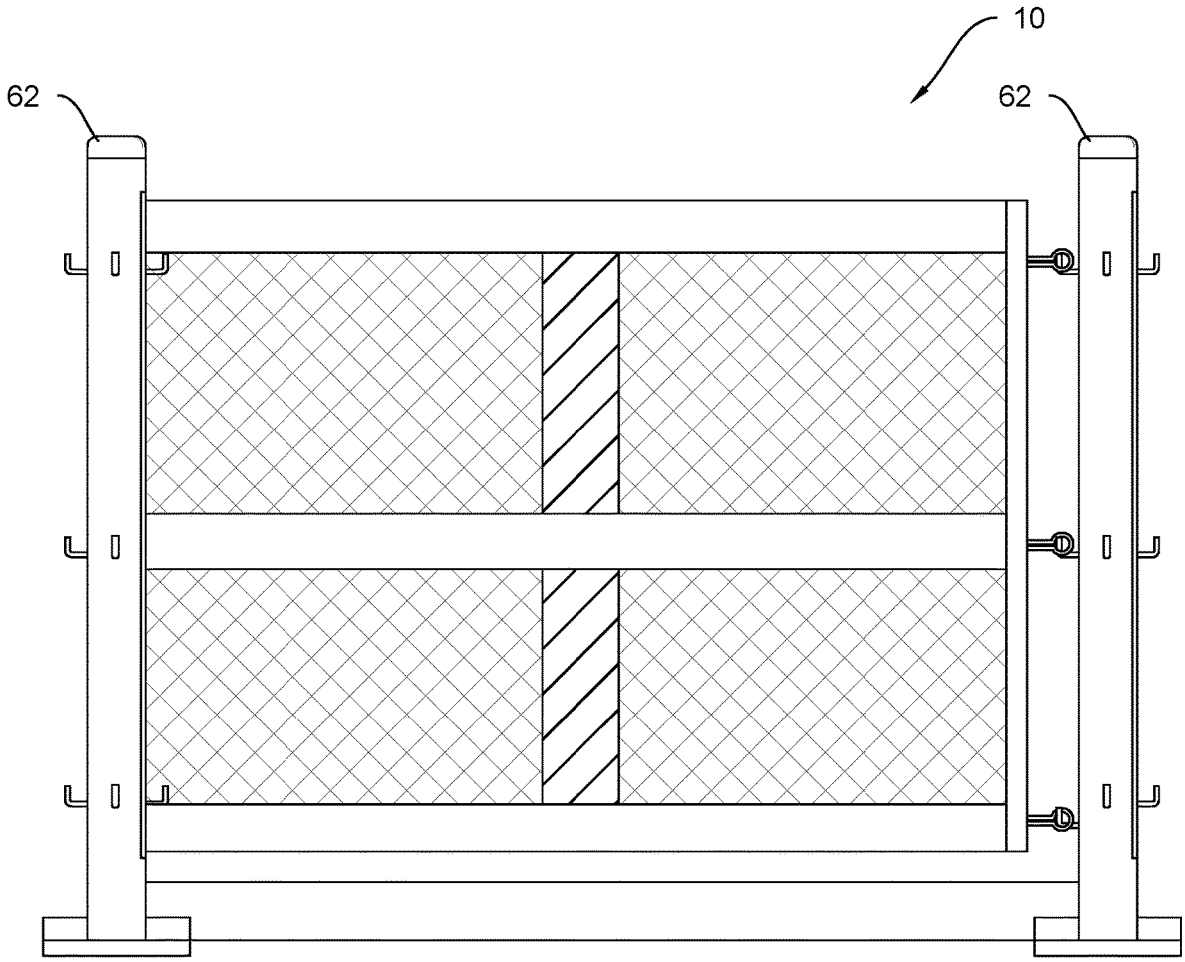
FIG. 1 represents an operational view of an exemplary embodiment of a barrier 10.

Referring now to the drawings, where the present invention is generally referred to with barrier 10, it can be observed that the barrier 10 includes a post assembly 20, a barrier assembly 40, and a warning assembly 60. It should be understood there are modifications and variations of the invention that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

Figure 2:
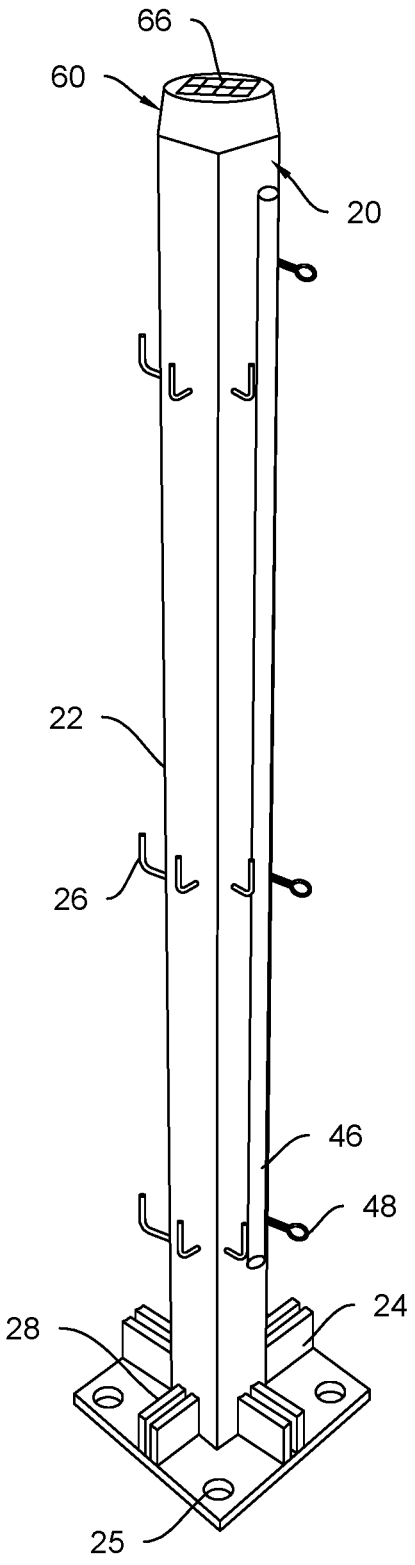
FIG. 2 shows an isometric view of a pole assembly 20, and a barrier assembly 40 when rewound inside a pole 22.
Figure 3:
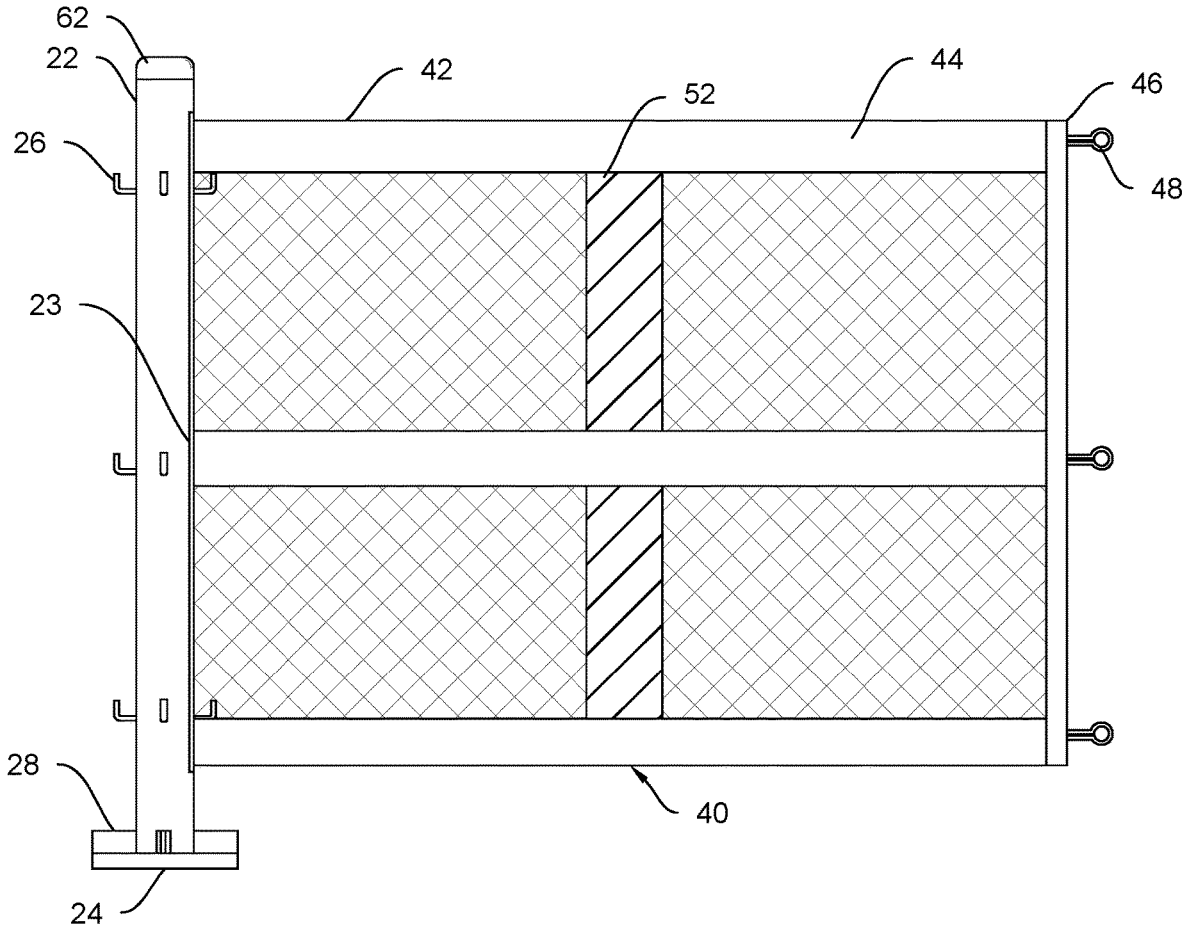
FIG. 3 illustrates a front view of the barrier 10 when unwound.

Post assembly 20 includes a post 22, a base 24, receiving members 26, toe kick securements 28, and a toe kick 30. In an exemplary embodiment, post 22 may be a sturdy square tube made of metal, wherein post 22 is fixed on the base 24. As FIG. 2 illustrates post 22 may be a rectangular tube, a tubular piece made of composite or any other shape or material capable of supporting a barrier such as netting. In a suitable embodiment, post 22 may include an aperture in a longitudinal portion thereof. As best illustrated in FIG. 3, aperture 23 may provide an access where netting 42 is deployed and retracted from the interior of the post 22. In a suitable embodiment, base 24 may be a rectangular shaped base that supports the post 22, thereby the post 22 may be placed freestanding onto the ground. Base 24 may be attached to the ground by means of fasteners passing through openings 25 placed along the base 24. FIG. 1 illustrates the post 22 being tangentially attached to the base 22, providing a configuration where a plurality of posts may be aligned to form a barrier by means of the netting 42. In a preferred embodiment, receiving members 26 are attached along and around the post 22, wherein the receiving members may be fasteners such as L-shaped screws or the like. As best depicted in FIG. 2, receiving members 26 are configured to receive and support the netting 42 from another post when deployed in order to form a barrier, preventing unauthorized entry in job sites.

Figure 4:
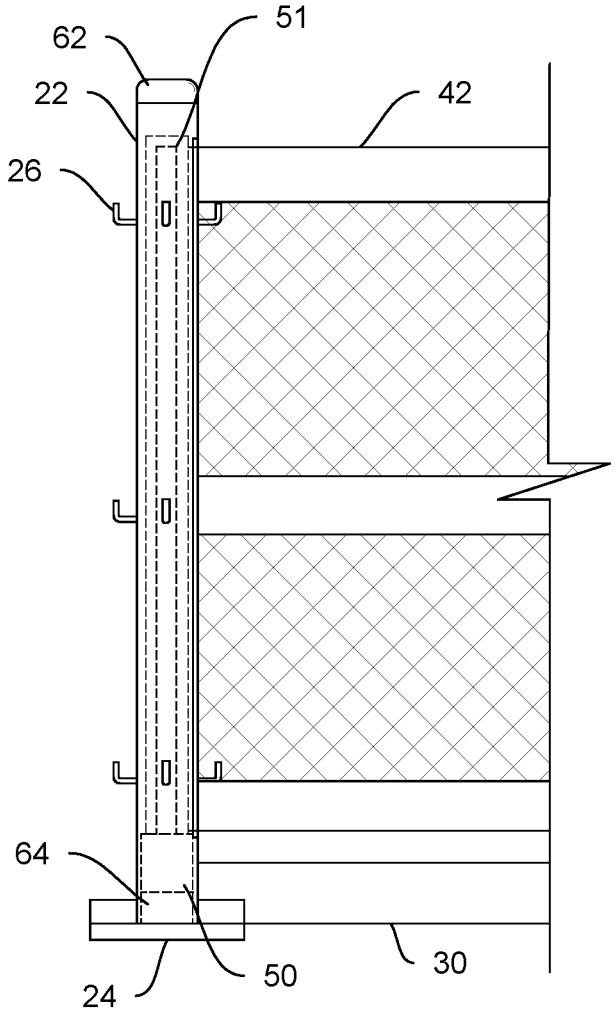
FIG. 4 is a view of the pole 22, wherein the barrier 10 allows netting 42 to be unwound.

Referring to FIG. 2, base 24 includes toe kick securements 28 in at least each side thereon, wherein each toe kick of the toe kick securements 28 is a rectangular-shaped support. In a suitable embodiment, toe kick securements 28 have an aperture in a center portion thereof that is adapted to receive the toe kick. As FIGS. 2 and 4 illustrates, kick securements 28 are attached parallelly with respect to the post 22 and perpendicular with respect to the base 24. As FIG. 2 represents, the toe kick securements 28 are attached to the base 24 and separated from the post 22. In one embodiment, toe kick securements 28 are attached to the base 24 and a plurality of other bases define a toe kick connection where toe kick 30 is coupled, thus toe kick 30 when installed may prevent any kind of materials, tools, debris, or the like from accidentally falling, or hitting or damaging anything that can slip through the bottom of the netting 42. In a preferred embodiment, toe kick 30 may be a rectangular shaped device with a predetermined length that goes from the post 22 towards another post thereof. As FIG.

1 depicts, toe kick 30 may be made of fire rated lumber or any other suitable material that resists impacts and fire.

Barrier assembly 40 includes the netting 42, straps 44, a support 46, fasteners 48, and a winder mechanism 50. In an exemplary embodiment, netting 42 may be an interlaced structure made of fire rated Polypropylene and Nylon wires. Netting 42 may be rewound around a cartridge that is removably inserted on a tube 51 from the winder mechanism 50 located inside the post 22. As FIG. 4 represents, straps 44 are attached along a top portion, center portion and bottom portion of the netting, and are reflective straps made of fire rated Polyester filament, although another fireproof material should be considered. In a preferred embodiment, straps 44 may include indicia to prevent unauthorized entry. In one embodiment, netting 42 includes a netting support 52 vertically fixed to prevent the netting 42 from sagging due to the weight thereof when deployed. As FIG. 3 shows, netting support 52 may be a strap made of a composite material, nevertheless, it should be considered that a plurality of netting supports may be fixed to netting 42 to provide support when fully extended. In a suitable embodiment, netting 42 further includes the support 46 fixed at a distal lateral end thereof, as FIG. 3 illustrates, wherein support 46 may be a sturdy structural piece that abuts against the post 22 when netting 42 is rewound inside the post 22, and as FIG. 2 represents, netting 42 may be unwound by pulling the support 46. It should be considered that support 46 may have a bigger diameter with respect to the aperture 23, also, the length of the support 46 should be considered larger than the length of the aperture 23. In other embodiment, fasteners 48 are attached along the length of the support 46, as FIG. 2 depicts, wherein fasteners 48 are screw eye hooks, eye bolts, hooks or the like. Referring to FIG. 1, fasteners 48 are parallelly displaced with respect to receiving members 26, therefore, fasteners are attached to the receiving members from another post when netting 42 is unwound to form the barrier.

In a preferred embodiment, winder mechanism 50 may be housed inside the post 22, as FIG. 4 illustrates, wherein winder mechanism 50 may include a rotational degree of freedom actuated by means of a spring-loaded mechanism that allows the tube 51 to rotate and return to its original position. Tube 51 may be a tubular device mounted on the winder mechanism 50. Tube 51 is configured to receive the netting by means of the cartridge, tube 51 and cartridge are secured in place by means of a locking mechanism, a flange and a recessed portion or any other suitable embodiment to secure the cartridge to the tube 51. It should be considered that netting 42 may be replaced when unlocking the cartridge from tube 51 and inserting a new one to said tube 51. In a suitable variation, straps 44 may include a plurality of eye bolts, open eye bolts, loops or any other suitable fastener, wherein said fasteners are placed along the top, center and bottom straps 44.

Warning assembly 60 includes a strobe light 62, a battery 64, and a solar panel 66. In an exemplary embodiment, strobe light 62 may be a device used to produce regular flashes of light to provide a visual alarm indicating and preventing unauthorized entry when the barrier is deployed. It should be considered that strobe light 62 may include multicolored lights. In a preferred embodiment, strobe light 62 may be placed on top of the post 22, as FIG. 2 depicts, wherein strobe light 62 may include the solar panel 66 on top thereof. In a suitable embodiment, solar panel 66 is electrically connected to the battery 64, thus the battery 64 is recharged by means of the solar panel 66 to provide power to the strobe light 62 when actuated. It should be considered that the battery 64 may be housed inside the post 22.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A deployable safety barrier for job sites, comprising:

a) a post assembly including a post, a base, and receiving members, wherein said post is a square tube structure attached to said base, wherein said base includes openings where fasteners pass therethrough, said receiving members are fasteners fixed along and around said post, said post assembly further includes a toe kick securements, and a toe kick, wherein said toe kick securements are supports attached to at least one side of the base, said kick securements are adapted to receive said toe kick;

b) a barrier assembly having a netting, straps, a support, fasteners, a winder mechanism, a tube, and a netting support, said netting is made of interlaced wires, wherein said netting is rewound inside said post, said straps are attached along said netting, said straps are reflective, a lateral end of said netting is fixed to said support, wherein said support provides a structural support for said netting, said fasteners are attached along said support, wherein said fasteners are parallel with respect to said receiving members, said tube is mounted around said winder mechanism, wherein said winder mechanism provides said tube a rotational degree of freedom, said netting further includes said netting support vertically attached to provide structural support to said netting; and c) a warning assembly including a strobe light, a battery, and a solar panel, said strobe light is coupled on top of said post, wherein said strobe light provides a visual alarm when actuated, said battery provides power to said strobe light, wherein said battery is recharged by means of said solar panel electrically connected thereto.

2. The deployable safety barrier for job sites of claim 1, wherein said post has a vertical aperture in a portion thereof.

3. The deployable safety barrier for job sites of claim 1, wherein said netting is made of fire rated Polypropylene and Nylon wires.

4. The deployable safety barrier for job sites of claim 1, wherein said straps are attached along said netting at a top, center, and bottom portion thereof.

5. The deployable safety barrier for job sites of claim 1, wherein said straps include indicia to prevent unauthorized entry.

6. The deployable safety barrier for job sites of claim 1, wherein said straps are made of fire rated Polyester filament.

7. The deployable safety barrier for job sites of claim 1, wherein said winder mechanism includes a spring-loaded mechanism that allows said netting to be unwound and automatically rewound.

8. The deployable safety barrier for job sites of claim 1, wherein said netting is removably mounted on said tube.

9. The deployable safety barrier for job sites of claim 1, wherein said strobe light produces regular flashes.

10. The deployable safety barrier for job sites of claim 1, wherein said toe kick securements are attached perpendicularly with respect to said base around said post.

11. The deployable safety barrier for job sites of claim 1, wherein said toe kick is a protection device under the netting that is mounted on at least one of said toe kick securements.

12. A deployable safety barrier for job sites, comprising:

a) a post assembly including a post, a base, and receiving members, wherein said post is a square tube attached to said base, wherein said base includes openings where fasteners pass therethrough, said receiving members are fasteners fixed along and around said post, said post has a vertical aperture in a portion thereof, said post assembly further includes a toe kick securements, and a toe kick, wherein said toe kick securements are supports attached to at least one side of the base, said kick securements are adapted to receive said toe kick, wherein said toe kick securements are attached perpendicularly with respect to said base around said post;

b) a barrier assembly having a netting, straps, a support, fasteners, a winder mechanism, a tube, and a netting support, said netting is made of interlaced wires, wherein said netting is rewound inside said post, said straps are attached along said netting, said straps are reflective, a lateral end of said netting is fixed to said support, wherein said support provides a structural support for said netting, said fasteners are attached along said support, wherein said fasteners are parallel with respect to said receiving members, said tube is mounted around said winder mechanism, wherein said winder mechanism provides said tube a rotational degree of freedom, said netting further includes said netting support vertically attached to provide structural support to said netting, said straps are attached along said netting at a top, center, and bottom portion thereof, said winder mechanism includes a spring-loaded mechanism that allows said netting to be unwound through said aperture and automatically rewound, said netting is removably mounted on said tube; and c) a warning assembly including a strobe light, a battery, and a solar panel, said strobe light is coupled on top of said post, wherein said strobe light provides a visual alarm when actuated, said battery provides power to said strobe light, wherein said battery is recharged by means of said solar panel electrically connected to thereof, said strobe light produces regular flashes.

13. A deployable safety barrier for job sites, consisting of:

a) a post assembly including a post, a base, and receiving members, wherein said post is a square tube structure attached to said base, wherein said base includes openings where fasteners pass therethrough, said receiving members are fasteners fixed along and around said post, said post has a vertical aperture in a portion thereof;

b) a barrier assembly having a netting, straps, a support, fasteners, a winder mechanism, a tube, and a netting support, said netting is made of interlaced wires, wherein said netting is rewound inside said post, said straps are attached along said netting, said straps are reflective, a lateral end of said netting is fixed to said support, wherein said support provides a structural support for said netting, said fasteners are attached along said support, wherein said fasteners are parallel with respect to said receiving members, said tube is mounted around said winder mechanism, wherein said winder mechanism provides said tube a rotational degree of freedom, said netting further includes said netting support vertically attached to provide structural support to said netting, said straps are attached along said netting at a top, center, and bottom portion thereof, said winder mechanism includes a spring-loaded mechanism that allows said netting to be unwound through said aperture and automatically rewound, said netting is removably mounted on said tube, said straps include indicia to prevent unauthorized entry, said netting is made of fire rated Polypropylene and Nylon wires, said straps are made of fire rated Polyester filament, said post assembly further includes toe kick securements, and a toe kick, wherein said toe kick securements are supports attached to at least one side of the base, said kick securements are adapted to receive said toe kick, wherein said toe kick securements are attached perpendicularly with respect to said base around said post, said toe kick is a protection device under the netting that is mounted on at least one of said toe kick securements; and c) a warning assembly including a strobe light, a battery, and a solar panel, said strobe light is coupled on top of said post, wherein said strobe light provides a visual alarm when actuated, said battery provides power to said strobe light, wherein said battery is recharged by means of said solar panel electrically connected to thereof, said strobe light produces regular flashes.

* * * * *